US008185029B2

(12) United States Patent
Isahai et al.

(10) Patent No.: US 8,185,029 B2
(45) Date of Patent: May 22, 2012

(54) FIXING DEVICE INCLUDING DEFORMABLE PEELING MEMBER AND IMAGE FORMING APPARATUS INCLUDING THE SAME

(75) Inventors: Satoshi Isahai, Saitama (JP); Yasuki Tanaka, Saitama (JP); Yukihiro Ichiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 209 days.

(21) Appl. No.: 12/636,368

(22) Filed: Dec. 11, 2009

(65) Prior Publication Data

US 2010/0247179 A1 Sep. 30, 2010

(30) Foreign Application Priority Data

Mar. 26, 2009 (JP) ..... 2009-077547

(51) Int. Cl.
*G03G 15/20* (2006.01)

(52) U.S. Cl. ..... 399/323

(58) Field of Classification Search ..... 399/323, 399/322, 398, 399, 406, 122; 219/216, 469–471; 271/307, 311, 312
See application file for complete search history.

(56) References Cited

U.S. PATENT DOCUMENTS

| | | | | | |
|---|---|---|---|---|---|
| 3,938,950 | A * | 2/1976 | Weiler et al. | 399/323 |
| 3,981,085 | A * | 9/1976 | Franko | 399/323 |
| 4,487,158 | A * | 12/1984 | Kayson | 271/311 |
| 4,755,848 | A * | 7/1988 | Tamary | 399/399 |
| 4,866,485 | A * | 9/1989 | Simpson | 399/323 |
| 4,905,049 | A * | 2/1990 | Bickerstaff et al. | 219/216 |
| 5,392,108 | A * | 2/1995 | DeWaters et al. | 399/399 |
| 5,448,347 | A * | 9/1995 | Mills | 399/323 |
| 5,517,292 | A * | 5/1996 | Yajima et al. | 399/323 |
| 5,548,389 | A * | 8/1996 | Bowler, Jr. | 399/406 |
| 5,600,428 | A * | 2/1997 | Yanagida | 399/399 |
| 6,265,694 | B1 * | 7/2001 | Pirwitz | 219/216 |
| 6,681,828 | B1 * | 1/2004 | Clough et al. | |
| 2002/0044803 | A1 * | 4/2002 | Kobaru et al. | 399/323 |
| 2003/0210933 | A1 * | 11/2003 | Mouri et al. | 399/323 |
| 2004/0146322 | A1 * | 7/2004 | Lee | 399/323 |
| 2005/0089352 | A1 * | 4/2005 | Lee et al. | 399/322 |
| 2009/0080953 | A1 * | 3/2009 | Hamilton et al. | 399/323 |

FOREIGN PATENT DOCUMENTS

JP 60-82659 U 6/1985

(Continued)

OTHER PUBLICATIONS

Notification of Reasons for Refusal issued Feb. 22, 2011 in counterpart Japanese Application No. 2009-077547.

*Primary Examiner* — Susan Lee
(74) *Attorney, Agent, or Firm* — Sughrue Mion, PLLC

(57) ABSTRACT

A fixing device comprises: a pair of fixing rotors, at least one of which has a heating source and both of which are rotated in pressure contact with each other; and a click-shaped peeling member provided on a downstream side of the fixing rotor with respect to a transporting direction of a recording medium and disposed in contact with a surface of the fixing rotor, wherein a tip portion of the click-shaped peeling member which is to come in contact with the fixing rotor is elastically deformed in conformity to a shape of a surface of the fixing rotor when coming in contact with the fixing rotor.

10 Claims, 13 Drawing Sheets

FOREIGN PATENT DOCUMENTS

| | | | | |
|---|---|---|---|---|
| JP | 01-277272 | A | | 11/1989 |
| JP | 6-67562 | A | | 3/1994 |
| JP | 07-140831 | A | | 6/1995 |
| JP | 09-146404 | A | | 6/1997 |
| JP | 2000259027 | A | * | 9/2000 |
| JP | 2001-075382 | A | | 3/2001 |
| JP | 2001337533 | A | * | 12/2001 |
| JP | 2003-122171 | A | | 4/2003 |
| JP | 2004-198635 | A | | 7/2004 |
| JP | 2005-300931 | A | | 10/2005 |
| JP | 2006-017794 | A | | 1/2006 |
| JP | 2006-154645 | A | | 6/2006 |
| JP | 2007-57628 | A | | 3/2007 |

* cited by examiner

FIXING DEVICE INCLUDING DEFORMABLE PEELING MEMBER AND IMAGE FORMING APPARATUS INCLUDING THE SAME

CROSS-REFERENCE TO RELATED APPLICATION

This application is based on and claims priority under 35 USC 119 from Japanese Patent Application No. 2009-077547 filed on Mar. 26, 2009.

BACKGROUND

1. Technical Field

The present invention relates to an improvement in a fixing device having a peeling member for peeling a recording medium subjected to a fixation from a fixing rotor and an image forming apparatus including the fixing device.

2. Related Art

In an image forming apparatus such as a copying machine or a printer utilizing an electrophotographic method, there has been widely used a fixing device for inserting a recording medium between a pair of fixing rotors constituted by a heating member and a pressurizing member and heating and pressurizing an unfixed toner image transferred onto the recording medium, thereby forming a permanent image.

SUMMARY

A fixing device comprises: a pair of fixing rotors, at least one of which has a heating source and both of which are rotated in pressure contact with each other; and a click-shaped peeling member provided on a downstream side of the fixing rotor with respect to a transporting direction of a recording medium and disposed in contact with a surface of the fixing rotor, wherein a tip portion of the click-shaped peeling member which is to come in contact with the fixing rotor is elastically deformed in conformity to a shape of a surface of the fixing rotor when coming in contact with the fixing rotor.

BRIEF DESCRIPTION OF THE DRAWINGS

Embodiments of the invention will be described in detail based on the following figures, wherein.

DETAILED DESCRIPTION

An exemplary embodiment according to the invention will be described below with reference to the drawings.

Figure 1:
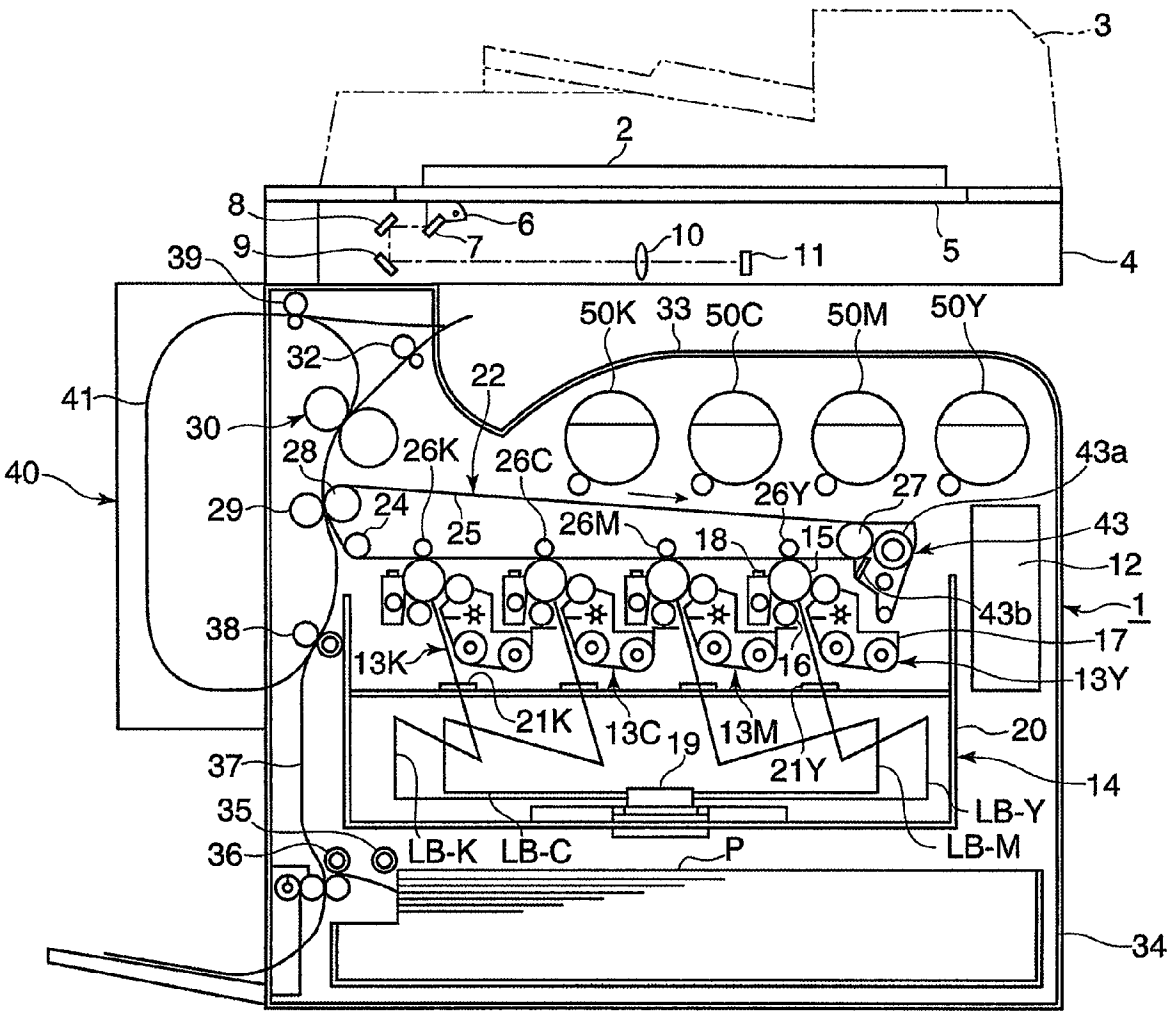
FIG. 1 is a schematic view showing a structure according to an exemplary embodiment of an image forming apparatus in accordance with the invention.

First of all, a schematic structure of an image forming apparatus to which the invention may be applied will be described with reference to FIG. 1. FIG. 1 is a view showing a structure of a tandem type digital color copying machine according to an example of the image forming apparatus to which the invention may be applied.

In FIG. 1, a body of a tandem type digital color copying machine according to an example of the image forming apparatus to which the invention may be applied is shown. An upper part of the body 1 is provided with an automatic document transporting device 3 for automatically transporting documents 2 one by one in a separating state, and a document reading device 4 for reading an image of the document 2 transported by the automatic document transporting device 3. The document reading device 4 illuminates the document 2 put on a platen glass 5 by means of a light source 6, scans and exposes a light image reflected from the document 2 onto an image reading device 11 constituted by a CCD through a reducing optical system formed by a full rate mirror 7, half rate mirrors 8 and 9 and an image forming lens 10, and thus reads a color material reflected light image of the document 2 in a predetermined dot density (for example, 16 dots/mm) by means of the image reading device 11.

The color material reflected light image of the document 2 which is read by the document reading device 4 is fed, to an image processing apparatus 12, as document reflectance data for three colors of red (R), green (G) and blue (B) (eight bits for each color), for example, and the image processing apparatus 12 carries out an image processing such as a shading correction, a positional shift correction, a brightness/color space conversion, a gamma correction, a frame erasure or a color/moving edit over the reflectance data of the document 2. Moreover, the image processing apparatus 12 serves to carry out a predetermined image processing over image data fed from a personal computer.

The image data subjected to the predetermined image processing through the image processing apparatus 12 as described above are converted into document reproducing color material gradation data for four colors of yellow (Y), magenta (M), cyan (C) and black (K) (eight bits for each color) by the image processing apparatus 12 and are fed to an exposing device 14 for image forming units 13Y, 13M, 13C and 13K for the respective colors of yellow (Y), magenta (M), cyan (C) and black (K) as will be described below. In the exposing device 14, an image is exposed through a laser beam LB corresponding to the document reproducing color material gradation data for each of the colors.

The four image forming units 13Y, 13M, 13C and 13K for the yellow (Y), the magenta (M), the cyan (C) and the black (K) are disposed in parallel at a certain interval in a horizontal direction in the tandem type digital color copying machine body 1.

All of the four image forming units 13Y, 13M, 13C and 13K are constituted in the same manner and are roughly constituted by a photosensitive drum 15 serving as an image holding member to be rotated and driven at a predetermined speed, a charging roll 16 for primary charging which uniformly charges a surface of the photosensitive drum 15, the exposing device 14 formed by a scanning optical system for exposing an image corresponding to each color and forming an electrostatic latent image on the surface of the photosensitive drum 15, a developing device 17 for developing the electrostatic latent image formed on the photosensitive drum 15 with a toner for each color (a developer), and a drum cleaning device 18 for cleaning the surface of the photosensitive drum 15.

The exposing device 14 is constituted in common to the four image forming units 13Y, 13M, 13C and 13K and has such a structure as to modulate four semiconductor lasers which are not shown corresponding to the document reproducing color material gradation data for each color and to emit laser beams LB-Y, LB-M, LB-C and LB-K from the semiconductor lasers depending on gradation data. It is a matter of course that the exposing device 14 is also constituted individually every image forming units. The laser beams LB-Y, LB-M, LB-C and LB-K emitted from the semiconductor lasers are irradiated on a rotating polygon mirror 19 through an f-θ lens which is not shown, and are deflected and scanned by the rotating polygon mirror 19. The laser beams LB-Y, LB-M, LB-C and LB-K deflected and scanned by the rotating polygon mirror 19 are scanned and exposed onto the photosensitive drum 15 obliquely and upward through a plurality of reflecting mirrors which is not shown.

The exposing device 14 has a periphery closed by means of a frame 20 taking a shape of a rectangular parallelepiped, and furthermore, windows 21Y, 21M, 21C and 21K formed by a transparent glass and serving as shielding members are provided on the frame 20 in order to expose the four laser beams LB-Y, LB-M, LB-C and LB-K onto the photosensitive drums 15Y, 15M, 15C and 15K of the image forming units 13Y, 13M, 13C and 13K. The windows 21Y, 21M, 21C and 21K formed of the glass are members placed in uppermost positions on an optical path along the laser beam LB of the exposing device 14.

Image data for the respective colors are sequentially output from the image processing apparatus 12 to the exposing device 14 provided in common to the image forming units 13Y, 13M, 13C and 13K for the respective colors of the yellow (Y), the magenta (M), the cyan (C) and the black (K), and the laser beams LB-Y, LB-M, LB-C and LB-K emitted from the exposing device 14 corresponding to the image data are scanned and exposed onto the surfaces of the corresponding photosensitive drums 15Y, 15M, 15C and 15K so that electrostatic latent images are formed. The electrostatic latent images formed on the photosensitive drums 15Y, 15M, 15C and 15K are developed as toner images (developer images) having the respective colors of the yellow (Y), the magenta (M), the cyan (C) and the black (K) by means of the developing devices 17Y, 17M, 17C and 17K, respectively.

The toner images having the respective colors of the yellow (Y), the magenta (M), the cyan (C) and the black (K) which are sequentially formed on the photosensitive drums 15Y, 15M, 15C and 15K of the image forming units 13Y, 13M, 13C and 13K are transferred on an intermediate transferring belt 25 disposed across the image forming units 13Y, 13M, 13C and 13K by means of primary transferring rolls 26Y, 26M, 26C and 26K in a multiplexing way. The intermediate transferring belt 25 is wrapped in a certain tension between a drive roll 27 and a backup roll 28 and is circulated and driven at a predetermined speed in a direction of an arrow through the drive roll 27 to be rotated and driven by a dedicated driving motor having an excellent constant speed property which is not shown. For the intermediate transferring belt 25, there is used a member obtained by forming, like a band, a synthetic resin film such as PET having a flexibility and connecting both ends of the synthetic resin film formed like the band through means such as welding, thereby taking a shape of a non-end belt, for example.

The toner images having the respective colors of the yellow (Y), the magenta (M), the cyan (C) and the black (K) which are transferred onto the intermediate transferring belt 25 in the multiplexing way are secondarily transferred onto a recording paper P by a pressure contact force and an electrostatic force by means of a secondary transferring roll 29 which comes in pressure contact with the backup roll 28. The recording paper P onto which the toner images having the respective colors are transferred is transported to a fixing device 30 positioned above. The secondary transferring roll 29 comes in pressure contact with a side of the backup roll 28 and serves to secondarily transfer the toner images having the respective colors onto the recording paper P transported in an upward direction from below. Then, the recording paper P onto which the toner images having the respective colors are transferred is subjected to a fixation processing by a heat and a pressure through the fixing device 30 and is then discharged onto a discharging tray 33 provided in an upper part of the body 1 by means of a discharging roll 32.

The recording paper P serving as a recording medium which has a predetermined size is once transported from a paper feeding cassette 34 to a resist roll 38 through a paper transporting path 37 by means of a paper feeding roller 35 and a paper separating and transporting roller pair 36, and is then stopped. The recording paper P supplied from the paper feeding cassette 34 is transmitted to a secondary transferring position of the intermediate transferring belt 25 by means of the resist roll 38 rotated in a predetermined timing.

In the digital color copying machine, in the case in which duplex copying for a full color is carried out, the recording paper P having an image fixed to either side is not exactly discharged onto the discharging tray 33 by means of the discharging roll 32 but a transporting direction is switched by a switching gate which is not shown, and the recording paper P is transported to a duplex transporting unit 40 through a paper transporting roller pair 39. In the duplex transporting unit 40, thereafter, the recording paper P is transported to the resist roll 38 again with both sides thereof inverted by means of a transporting roller pair (not shown) provided along a transporting path 41, and subsequently, an image is transferred and fixed onto the back side of the recording paper P and the recording paper P is thereafter discharged onto the discharging tray 33.

All of the four image forming units 13Y, 13M, 13C and 13K for the yellow color, the magenta color, the cyan color and the black color are constituted in the same manner. The four image forming units 13Y, 13M, 13C and 13K have the structure in which the toner images having the yellow, magenta, cyan and black colors are sequentially formed in a predetermined timing respectively as described above. The image forming units 13Y, 13M, 13C and 13K for the respective colors include the photosensitive drums 15 as described above, and the surfaces of the photosensitive drums 15 are uniformly charged by the primary charging roll 16. Then, the image forming laser beam LB emitted from the exposing device 14 depending on image data is scanned and exposed onto the surface of the photosensitive drum 15 so that an electrostatic latent image corresponding to each of the colors is formed. The laser beam LB scanned and exposed onto the photosensitive drum 15 is set to be exposed at a predetermined tilt angle from obliquely below slightly close to a right side from a portion provided under the photosensitive drum 15. The electrostatic latent images formed on the photosensitive drums 15 are developed with the toners having the yellow, magenta, cyan and black colors by means of the developing rolls of the developing devices 17 in the image forming units 13Y, 13M, 13C and 13K and are thus changed into visible toner images, respectively. The visible toner images are sequentially transferred onto the intermediate transferring belt 25 by a charging operation of the primary transferring roll 26 in a multiplexing way.

A residual toner or paper powder is removed from the surface of the photosensitive drum 15 subjected to the step of transferring the toner image by means of the drum cleaning device 18 to prepare for a next image forming process. The drum cleaning device 18 includes a cleaning blade which is not shown and serves to remove the residual toner or paper powder on the photosensitive drum 15 by means of the cleaning blade. Moreover, the residual toner or paper powder is removed from a surface of the intermediate transferring belt 25 subjected to the step of transferring the toner image by means of a belt cleaning device 43 to prepare for a next image forming process. The belt cleaning device 43 includes a cleaning brush 43*a* and a cleaning blade 43*b*. The residual toner or paper powder on the intermediate transferring belt 25 is removed by means of the cleaning brush 43*a* and the cleaning blade 43*b*.

In the exemplary embodiment, moreover, toner cartridges 50Y, 50M, 50C and 50K for supplying predetermined color developers (mainly toners or toners containing carriers) to the developing devices 17 for the respective colors of the yellow (Y), the magenta (M), the cyan (C) and the black (K) are disposed above the intermediate transferring belt 25.

Figure 2:
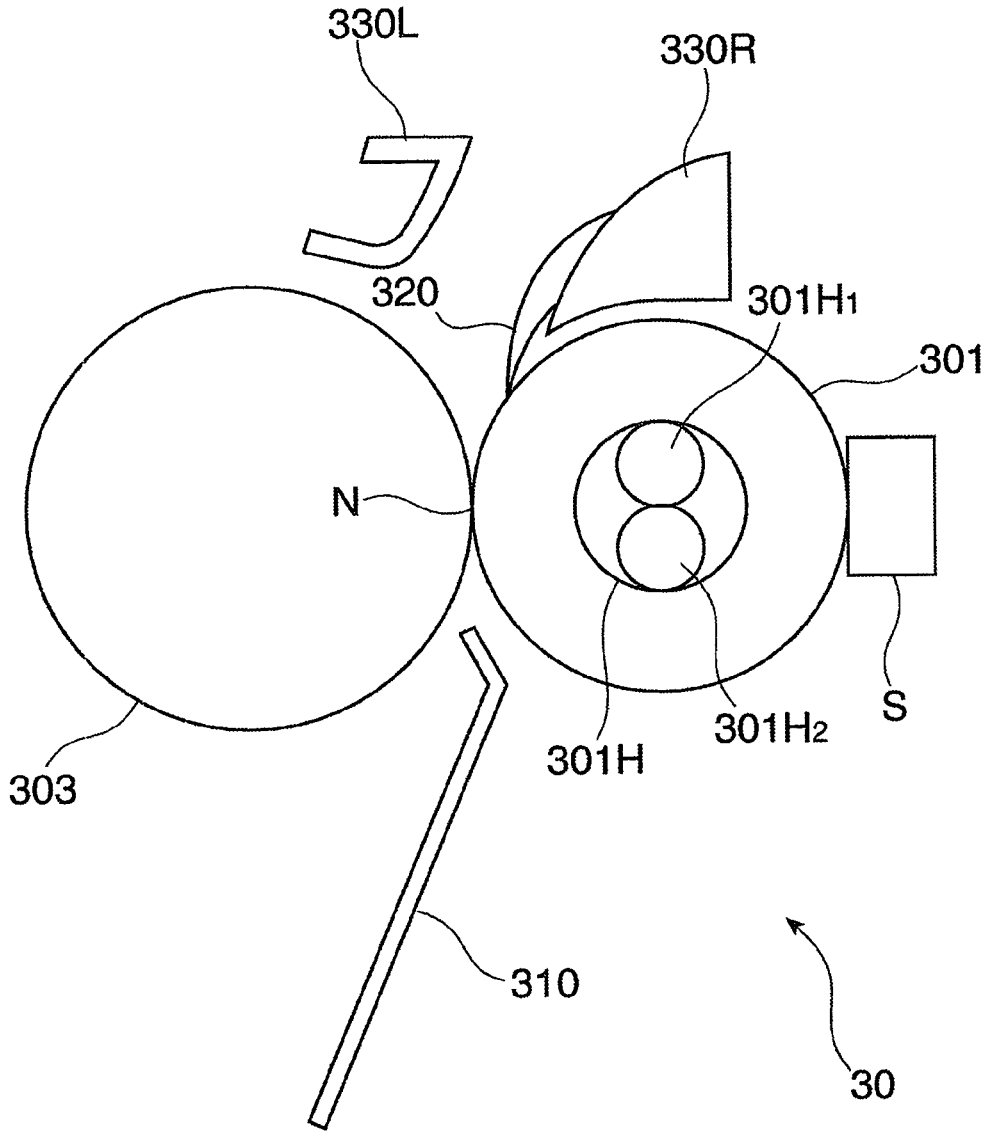
FIG. 2 is a typical view for explaining a structure of a fixing device according to the exemplary embodiment.

Next, a structure of the fixing device 30 according to the exemplary embodiment will be described with reference to FIG. 2. FIG. 2 is a typical view for explaining the structure of the fixing device 30 according to the exemplary embodiment.

As shown in FIG. 2, the fixing device 30 according to the exemplary embodiment includes a heating roll 301 having a heating source therein and connected to a driving source which is not shown and formed rotatably, and a pressurizing roll 303 provided in pressure contact with the heating roll 301 by a predetermined pressure opposite to the heating roll 301 and formed rotatably to be driven with a rotation of the heating roll 301. In a transporting direction of the recording paper P, furthermore, an inlet chute 310 for guiding the recording paper P having an unfixed toner image formed thereon to the fixing device 30 is provided on an upstream side (a lower side in the drawing) of a fixing nip portion N in which the heating roll 301 and the pressurizing roll 303 come in pressure contact with each other, and at a downstream side, there are provided a peeling member 320 for separating and transporting the recording paper P subjected to the fixation from a fixing rotor and a pair of transport guiding members (transport guiding members) 330R and 330L for guiding the transport of the recording paper P separated by the peeling member 320.

Then, the recording paper P having the unfixed image formed thereon is guided by the inlet chute 310 and is inserted into the fixing nip portion N, and at the same time, is heated and pressurized and is subjected to an image fixation. Thereafter, the recording paper P passing through the fixing nip portion N is promoted to be peeled from a surface of the heating roll 301 by means of the peeling member 320 and is thus transported toward the discharging tray 33 through the transport guiding member 330.

In the heating roll 301 to be a heating member according to the exemplary embodiment, an elastic layer constituted by a silicone rubber is provided on a surface of a cylindrical core formed of a metal such as aluminum which is excellent in a mechanical strength and has a high thermal conductivity, and furthermore, a mold releasing layer constituted by a fluororesin layer such as a PFA tube which is provided to prevent an offset of an unfixed toner image on the recording paper P is formed on a surface of the elastic layer. Moreover, the core includes a heating source 301H constituted by two halogen lamps 301$H_1$ and 301$H_2$, for example. Heating is carried out to set a surface temperature of the heating roll 301 into a predetermined temperature so that the recording paper P having an unfixed toner image formed thereon is heated. In the exemplary embodiment, one of side surfaces of the heating roll 301 (a right side surface in the drawing according to the example) is provided with a temperature sensor S for detecting the surface temperature of the heating roll 301 in a paper passing region of the recording paper P. A temperature of the heating source 301H is controlled based on a result of the detection of the temperature sensor S in such a manner that the surface temperature of the heating roll 301 is set to be a predetermined temperature.

On the other hand, for example, an elastic layer formed by a silicone rubber having a rubber hardness (JIS-A) of approximately 40° is covered around a metallic core, and furthermore, a surface layer constituted by a fluororesin layer such as a PFA tube is formed on a surface thereof, and the pressurizing roll 303 to be a pressurizing member is pressed against the heating roll 301 to apply a predetermined pressure contact force to the pressure contact region (the fixing nip region) N formed together with the heating roll 301.

For a heating source, it is possible to use induction heating in addition to the halogen lamp. In the case in which the induction heating is employed, it is also possible to have a structure in which a fixing rotor itself generates a heat. For the fixing rotor, moreover, it is possible to apply an optional combination of a belt, a film and a roll. In the exemplary embodiment, there is employed an opposed roll structure of the heating roll 301 and the pressurizing roll 303.

Furthermore, a pair of transport guiding members 330R and 330L according to the exemplary embodiment is provided opposite to each other at a downstream side of the fixing nip portion N and is constituted by the transport guiding member 330R disposed on the heating roll 301 side and the transport guiding member 330L disposed on the pressurizing roll 303 side. In addition, the peeling member 320 which will be described below is attached integrally with the transport guiding member 330R on the heating roll 301 side. Referring to the transport guiding member 330L on the pressurizing roll 303 side, it is possible to apply the conventionally known transport guiding member properly and optionally.

Figure 3:
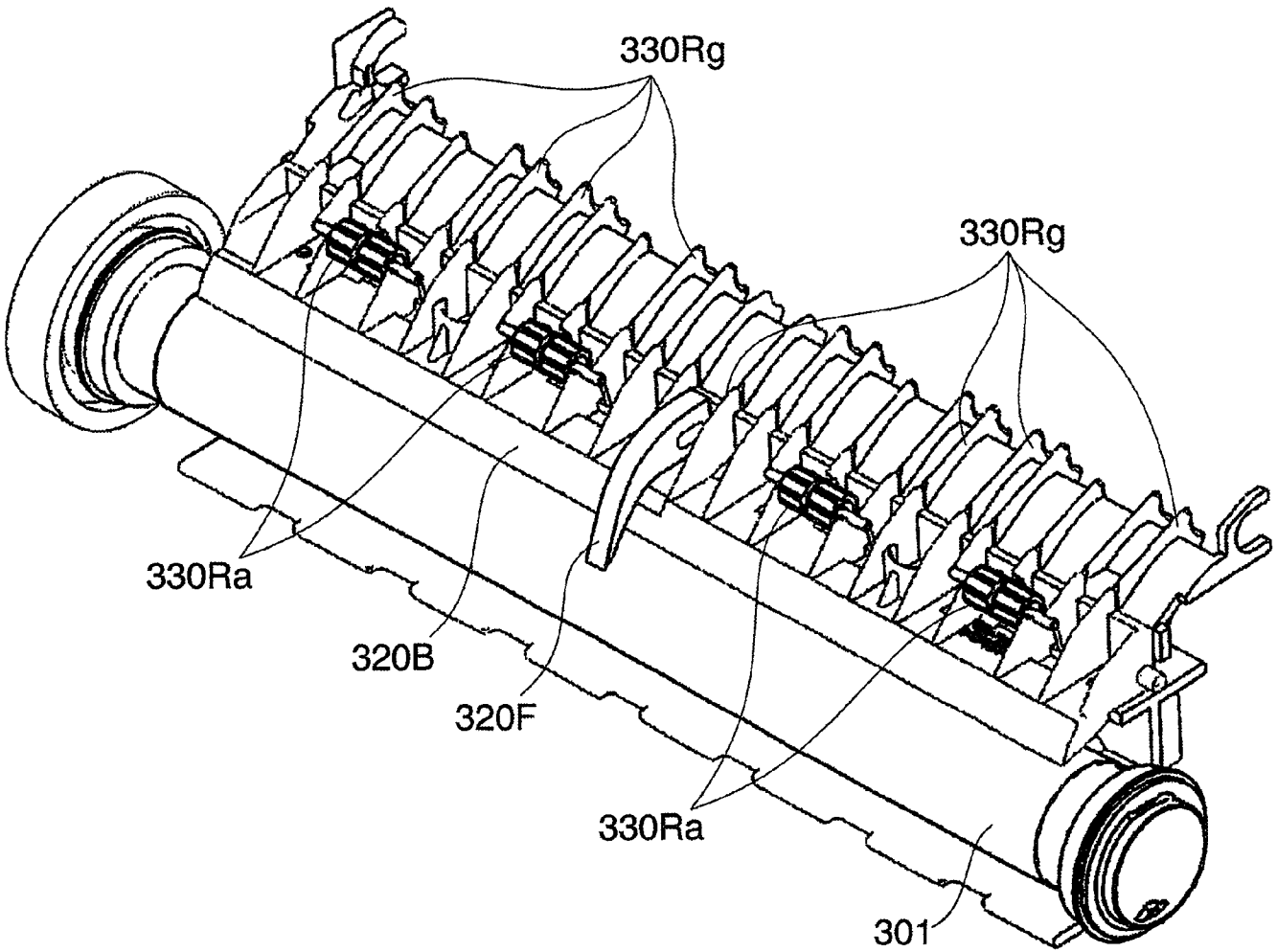
FIG. 3 is a perspective view for explaining a structure of a transport guiding member according to the exemplary embodiment.

Next, a structure of the peeling member 320 according to the exemplary embodiment will further be described with reference to FIGS. 3 to 5. FIG. 3 is a perspective view for explaining a structure of the transport guiding member 330 according to the exemplary embodiment. Moreover, FIG. 4 is a perspective view showing a state in which the heating roll 301 and the transport guiding member 330 are cut in an almost central part in an axial direction and FIG. 5 is a sectional view showing the same state.

Figure 4:
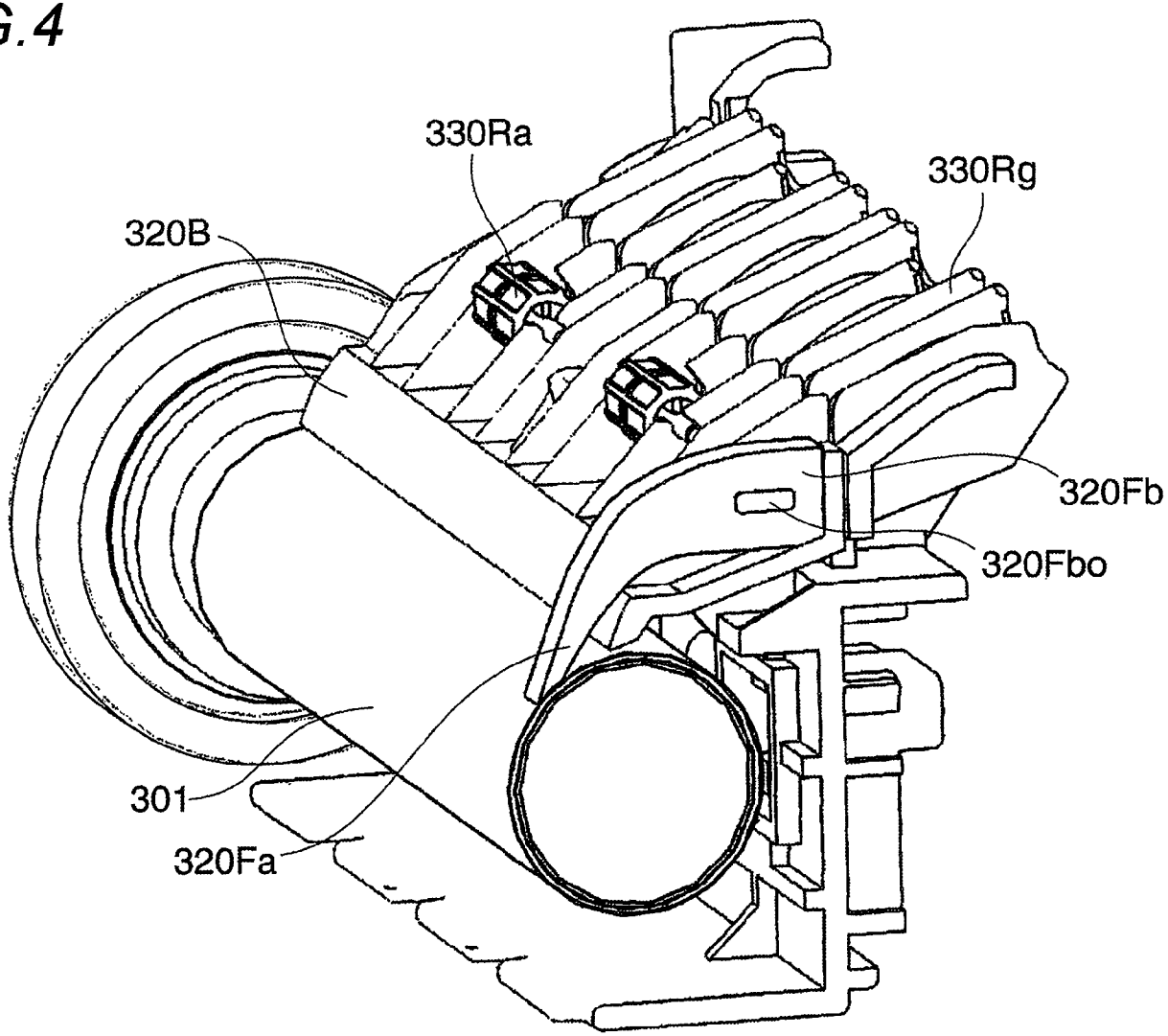
FIG. 4 is a perspective view showing a state in which a heating roll and the transport guiding member are cut in an almost central part in an axial direction according to the exemplary embodiment.
Figure 5:
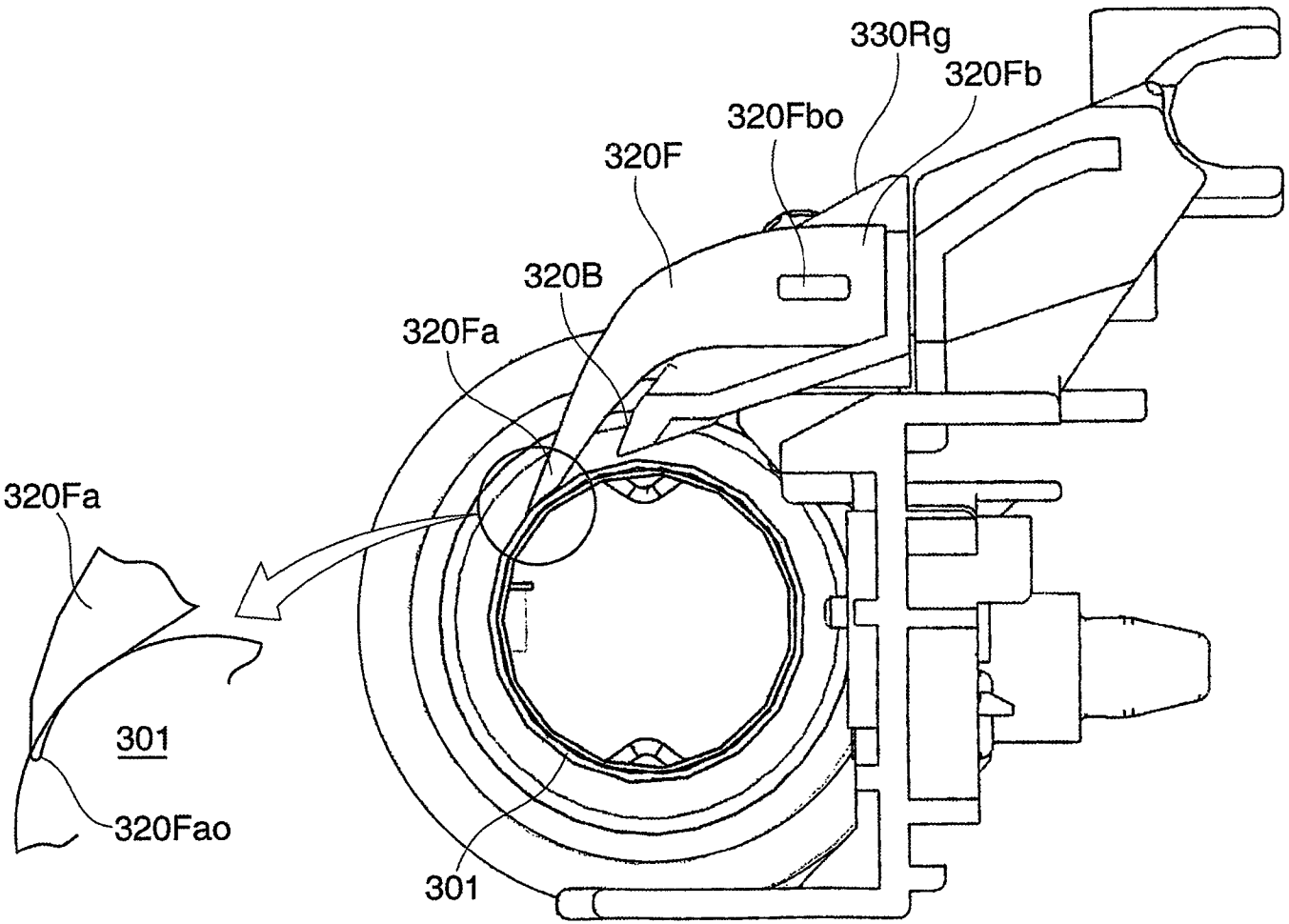
FIG. 5 is a sectional view showing a state in which the heating roll and the transport guiding member are cut in the almost central part in the axial direction according to the exemplary embodiment.

As shown in FIGS. 3 to 5, the peeling member 320 according to the exemplary embodiment is formed integrally with the transport guiding member 330R on the heating roll 301 side, and is constituted by a click-shaped peeling finger 320F disposed in a central part in the axial direction of the heating roll 301 in such a manner that a tip portion 320Fa comes in contact with the surface of the heating roll 301, and a plate-shaped peeling baffle 320B disposed opposite in the axial direction of the heating roll 301 in non-contact with the surface of the heating roll 301. The peeling finger 320F may be formed integrally with the transport guiding member 330R through two-color molding or may be prepared as a separate component and attached integrally. Moreover, the peeling baffle 320B may be formed integrally with the transport guiding member 330R, may be formed integrally with the transport guiding member 330R through the two-color molding or may be prepared as a separate component and attached integrally.

More specifically, the transport guiding member 330R includes a plurality of almost triangular guide ribs 330Rg which is protruded orthogonally to the axial direction and is disposed in the axial direction, and a plurality of transporting rolls 330Ra disposed in symmetrical positions (four places in the example) around a center of a paper width and formed by an elastic member such as a rubber. Furthermore, a tip of the guide rib 330Rg is provided with the plate-shaped peeling baffle 320B which is extended in the axial direction to be opposed to the surface of the heating roll 301 in non-contact, and a central part in the axial direction is provided with the click-shaped peeling finger 320F with a tip thereof formed in contact with the surface of the heating roll 301.

Figure 6:
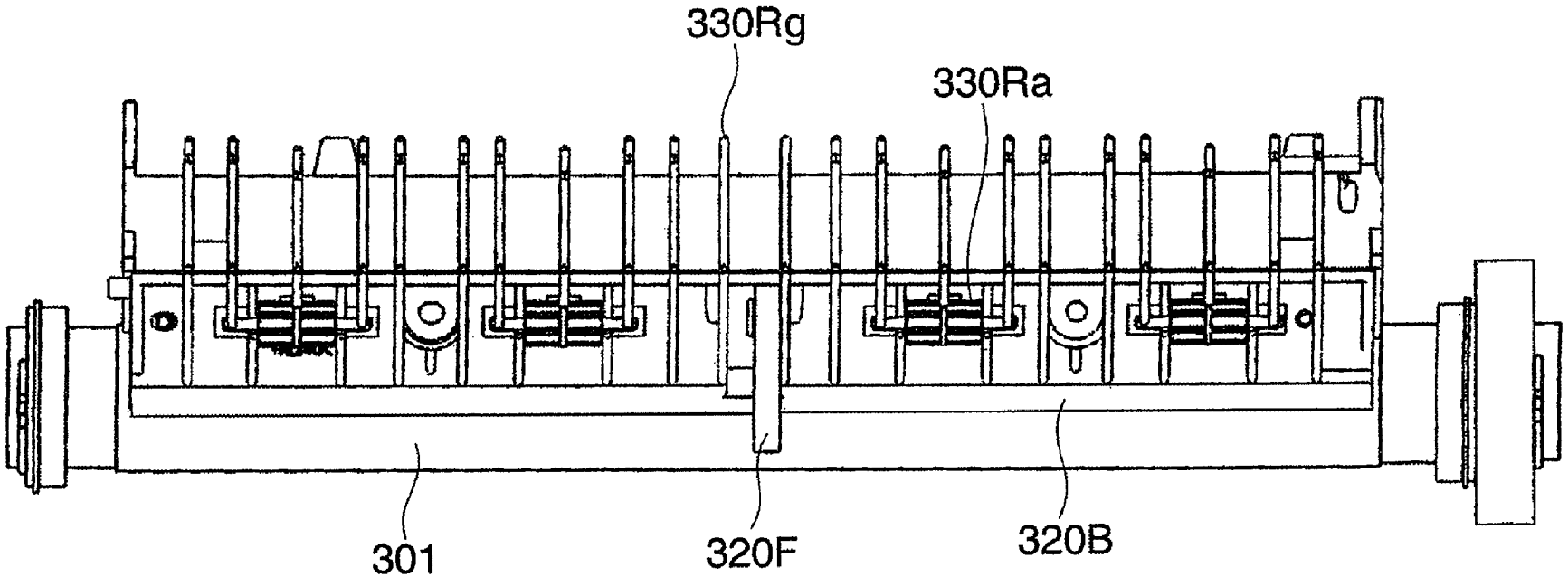
FIG. 6 is a typical view showing an example of a shape of a peeling baffle according to the exemplary embodiment.
Figure 7:
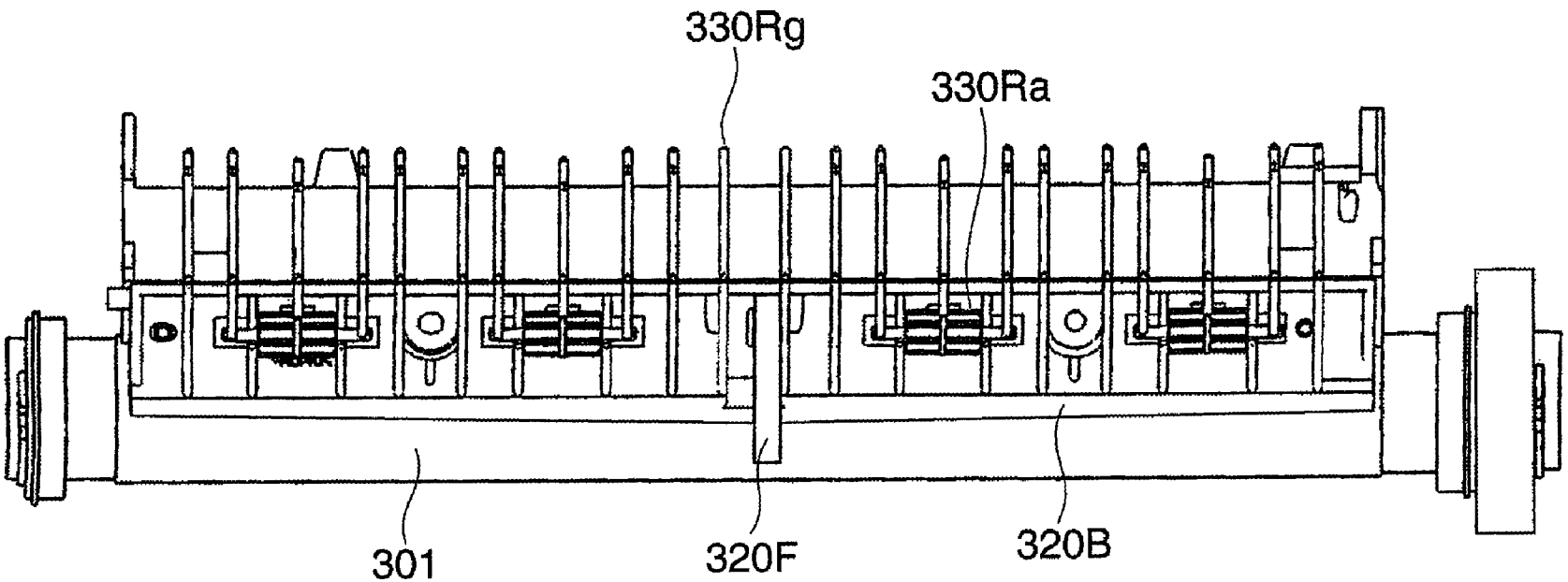
FIG. 7 is a typical view showing an example of the shape of the peeling baffle according to the exemplary embodiment.
Figure 8:
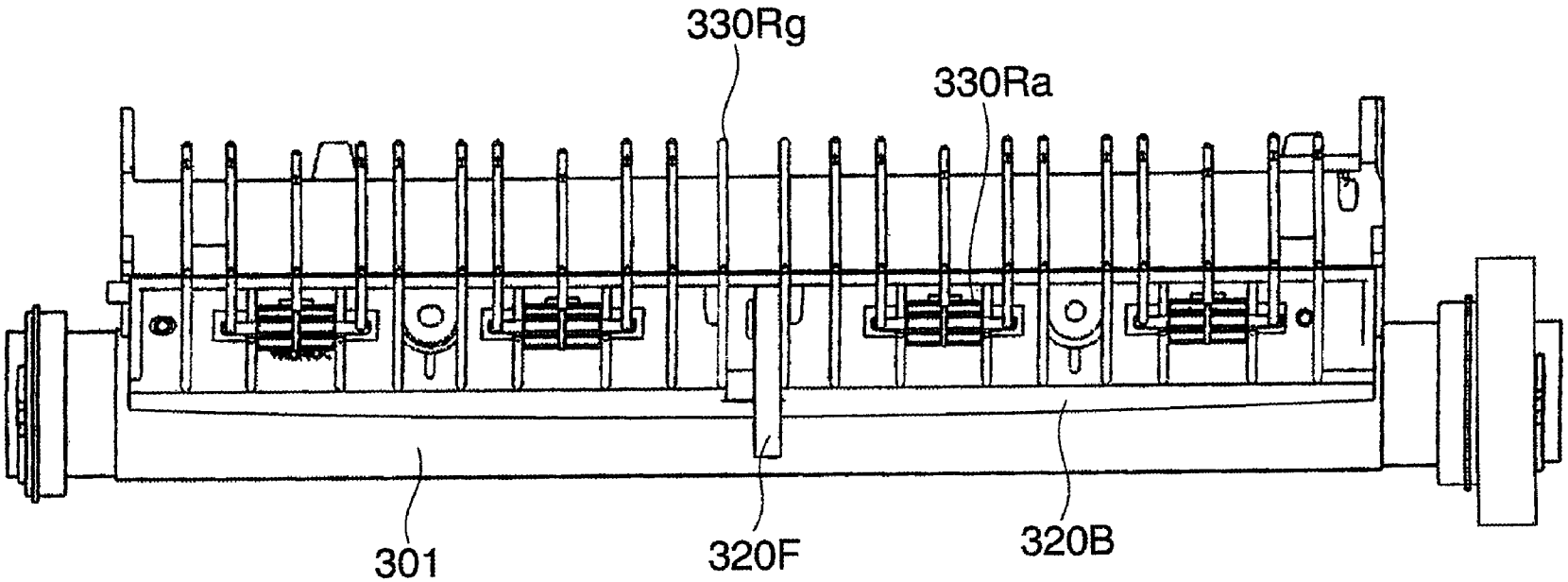
FIG. 8 is a typical view showing an example of the shape of the peeling baffle according to the exemplary embodiment.

The peeling baffle 320B according to the exemplary embodiment may be formed integrally with the transport guiding member 330R by a general and inexpensive heat-resistant resin, for example, PET or LCP, and may take a rectangular shape which is parallel with the axial direction as shown in FIG. 6, a V shape in which a length in a transporting direction from the central part in the axial direction toward both ends in the axial direction is rectilinearly decreased as shown in FIG. 7 or a curved shape in which the length in the transporting direction from the central part in the axial direction toward the both ends in the axial direction is decreased like a curve as shown in FIG. 8.

On the other hand, the peeling finger 320F according to the exemplary embodiment is formed by a fluororesin having an excellent mold releasing property and an elasticity (for example, PFA: tetrafluoroethylene—perfluoroalkoxyethylene copolymer, PTFE: polytetrafluoroethylene, FEP: tetrafluoroethylene—hexafluoropropylene copolymer) and is formed in such a manner that the tip portion 320Fa is elastically deformed by itself in conformity with the shape of the surface of the heating roll 301 when it comes in contact with the heating roll 301. The tip portion 320Fa of the peeling finger 320F may be more difficult for a lower hardness than that of the elastic layer of the heating roll 301 to generate a crease over the mold releasing layer formed on the surface of the elastic layer. Even if the tip portion 320Fa of the peeling finger 320F has a hardness which is equal to or higher than that of the elastic layer of the heating roll 301, there is no problem if the mold releasing layer is not damaged as a result of the generation of the crease over the mold releasing layer formed on the surface of the elastic layer.

In detail, as shown in the best way in FIG. 5, the peeling finger 320F is formed to take a shape of a bow in which the tip portion 320Fa is tapered, and a base end 320Fb is attached between the guide ribs 330Rg in an almost coaxial position with the transporting roll 330Ra. In FIG. 5 in which the tip portion 320Fa is typically shown, furthermore, a contact portion $320Fa_0$ with the heating roll 301 which is provided on the tip of the peeling finger 320F is formed to take a shape of a curved surface which has a greater radius of curvature than that of the surface of the heating roll 301 in a non-contact state.

By fixing the base end 320Fb of the peeling finger 320F between the guide ribs 330Rg at a downstream side from the peeling baffle 320B, thus, it is possible to promote the elastic deformation of the tip portion 320Fa more greatly as compared with a structure in which the base end 320Fb is formed integrally with the peeling baffle 320B.

Figure 9:
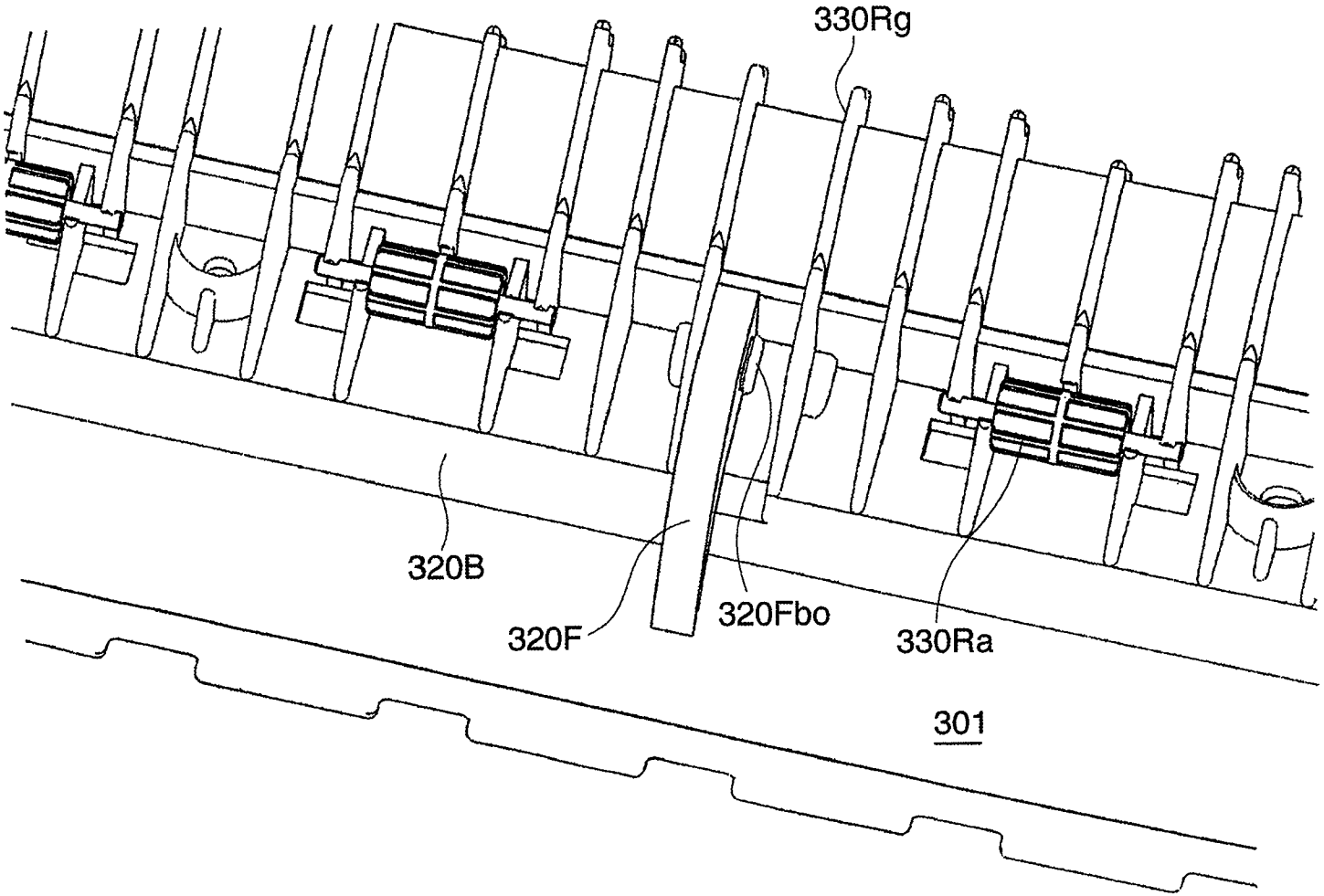
FIG. 9 is a typical view showing an attaching state of the peeling baffle according to the exemplary embodiment.

By providing the peeling finger 320F between the guide ribs 330Rg, moreover, it is possible to insert position and fix the peeling finger 320F in the axial direction. Thus, it is possible to prevent, with a simple structure, a positional shift such as a float of the peeling finger 320F in the case in which the transport of the recording paper P is guided. More specifically, in the exemplary embodiment, a rectangular fixed shaft $320Fb_0$ which is protruded in the axial direction is provided on one of the opposed guide ribs 330Rg and a corresponding rectangular through hole provided on the peeling finger 320F is inserted into the rectangular shaft $320Fb_0$ as shown in FIG. 9, for example. Consequently, it is possible to position and fix the peeling finger 320F. In the exemplary embodiment, furthermore, there is employed a so-called snap fit shape in which only the tip portion of the rectangular fixed shaft $320Fb_0$ is formed to be slightly larger than the through hole of the corresponding peeling finger 320F. Thus, it is possible to regulate positional shifts in a direction of a side surface of the peeling finger 320F (the axial direction) and a paper transporting direction, and furthermore, to enhance an assembling property and to prevent slip-off.

By forming the contact portion $320Fa_0$ of the tip portion 320Fa of the peeling finger 320F with the heating roll 301 as a curved surface having a greater radius of curvature than that of the surface of the heating roll 301, furthermore, it is possible to cause the tip portion 320Fa to come in face contact with the heating roll 301 more stably. Consequently, it is possible to prevent a vibration such as a so-called jitter or a float in the tip portion 320Fa, and furthermore, to contribute to an enhancement in a paper peeling property.

In order to promote the elastic deformation of the tip portion 320Fa of the peeling finger 320F more greatly, a round hole penetrating in the axial direction may be provided on the tip portion 320Fa or a thickness in the axial direction of the tip portion 320Fa may be gradually reduced toward a tip.

Although there has been illustrated the structure in which the peeling finger 320F is disposed on only the central part in the axial direction of the heating roll 301 in respect of a compatibility of a maintenance of a peeling performance and a reduction in a cost in the exemplary embodiment, moreover, it is a matter of course that the peeling finger 320F may be disposed in a plurality of portions (for example, both ends in the axial direction).

Figure 10:
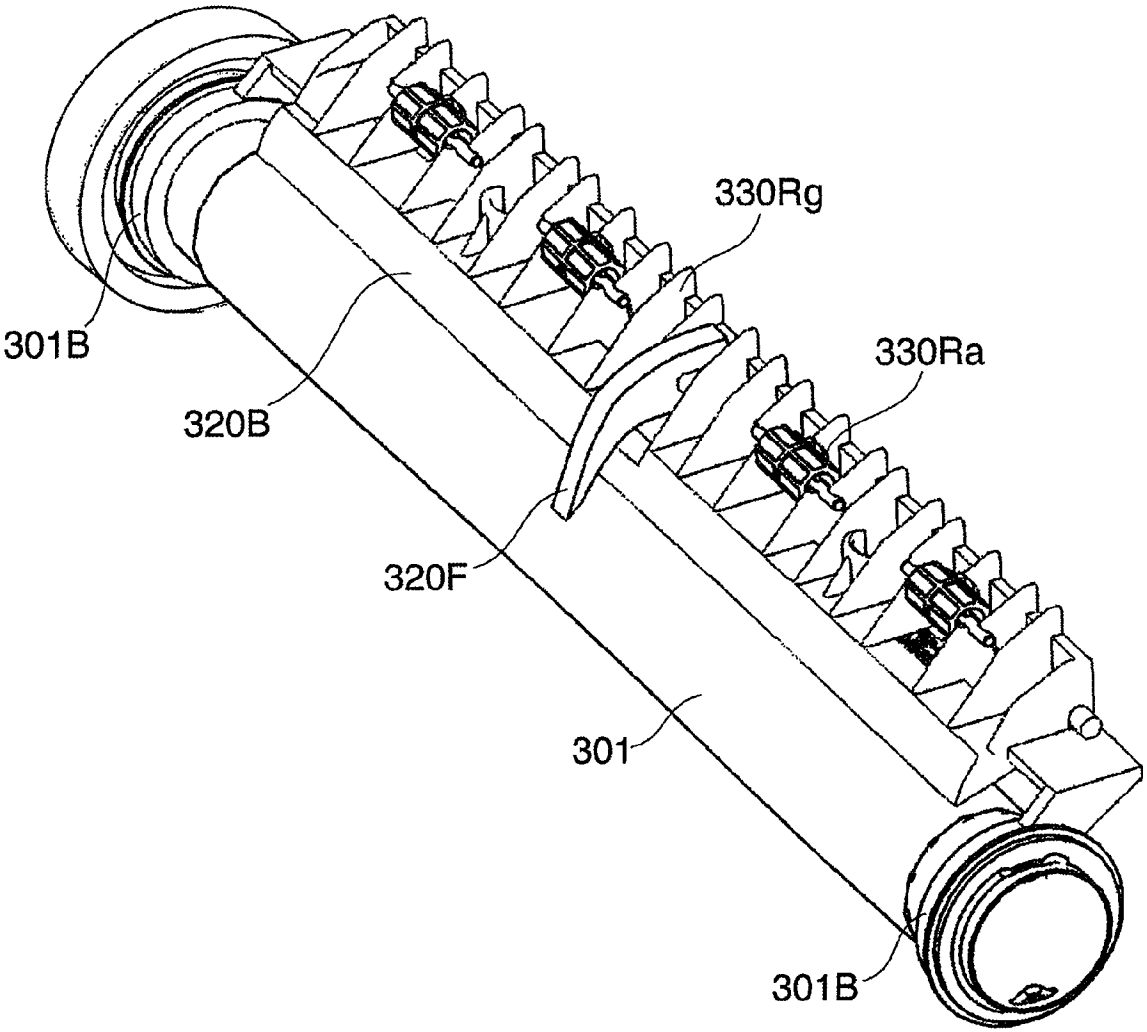
FIG. 10 is a perspective view showing a positioning state of the transport guiding member formed integrally with a peeling member according to the exemplary embodiment.
Figure 11:
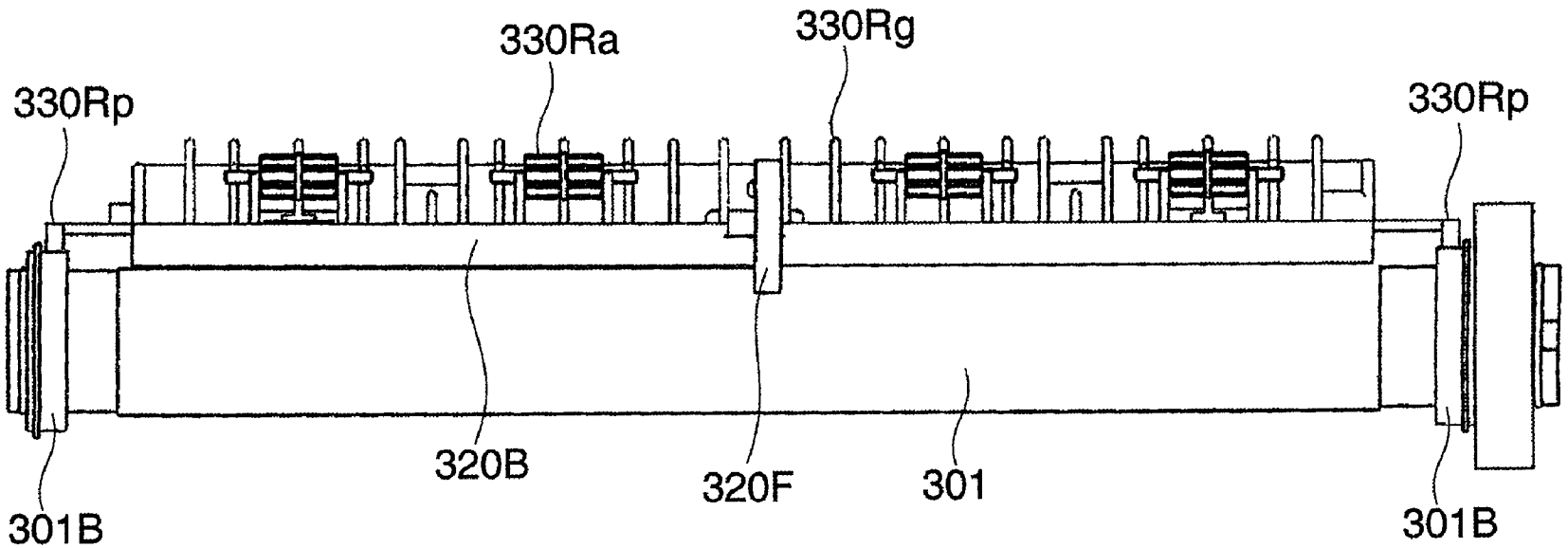
FIG. 11 is a typical view showing the positioning state of the transport guiding member formed integrally with the peeling member according to the exemplary embodiment.

In addition, the transport guiding member 330R formed integrally with the peeling member 320 according to the exemplary embodiment may be positioned by causing a positioning member $330R_P$ provided on both ends in the axial direction to abut on a bearing member 301B of the heating roll 301 as shown in FIGS. 10 and 11.

By carrying out relative positioning with the heating roll 301 through a close member to the heating roll 301, thus, it is possible to position the tip of the peeling member 320 formed integrally with the transport guiding member 330R (particularly, the peeling finger 320F to be deformed elastically by itself) with high precision. In order to position the peeling members 320F and 320B with high precision, it is also possible to gradually push the tip portion 320Fa of the peeling finger 320F to be deformed elastically against the heating roll 301 and to position and fix the peeling members 320F and 320B into a support housing (for example, the transport guiding member 330R or an apparatus housing) when a predetermined pressure contact force (a reaction force) is obtained.

Figure 12:
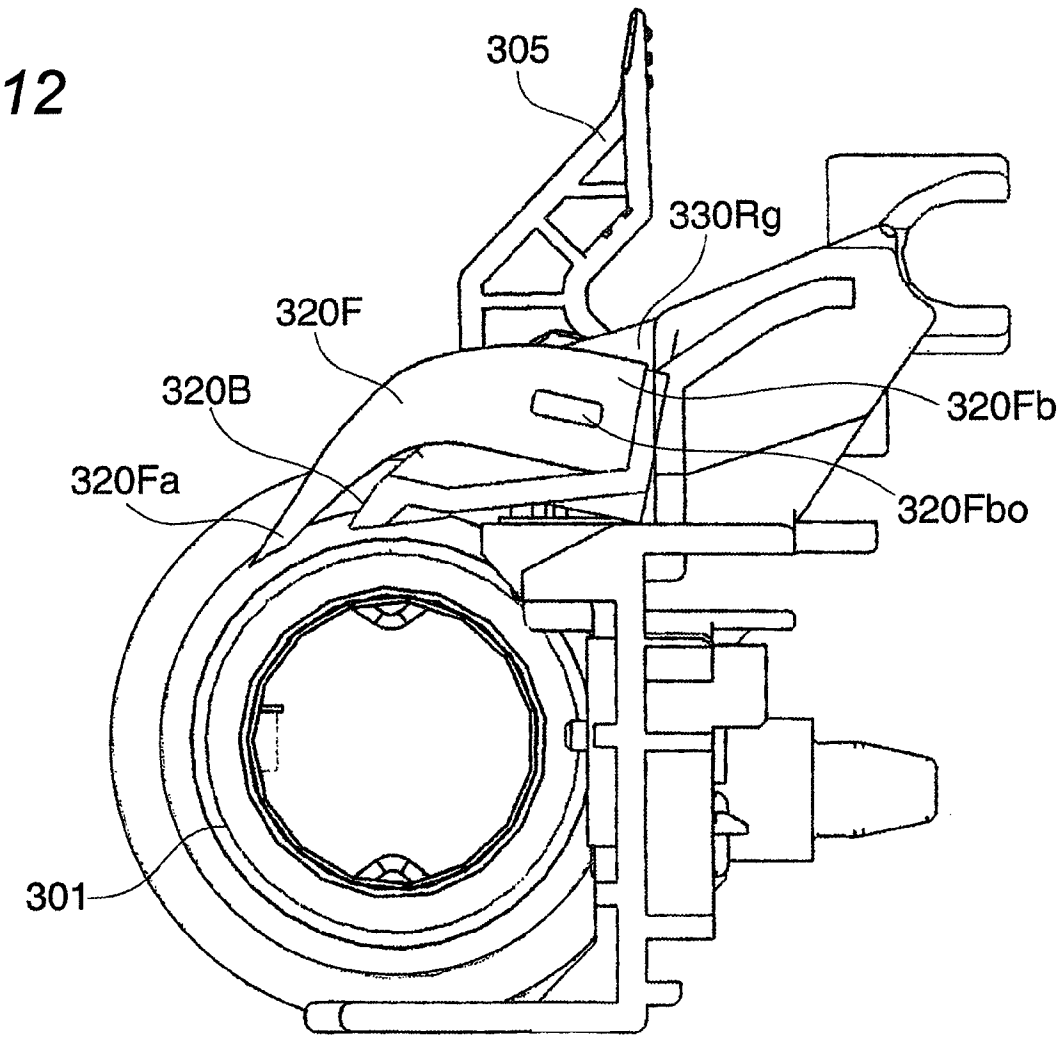
FIG. 12 is a typical view showing an interlocking state with a nip releasing lever of the peeling member according to the exemplary embodiment.
Figure 13:
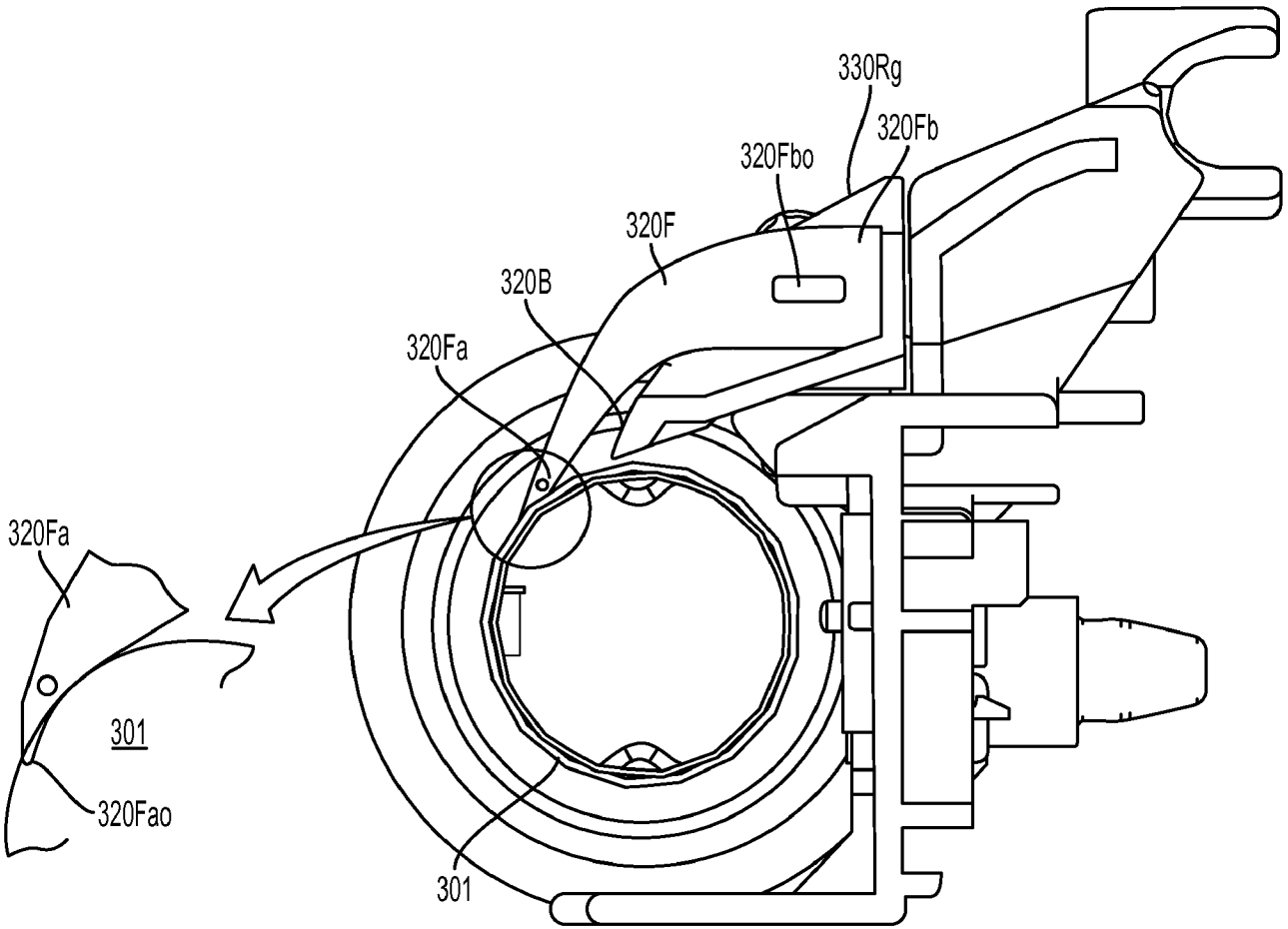
FIG. 13 is a sectional view showing a state in which the heating roll and the transport guiding member are cut in the almost central part in the axial direction according to an exemplary embodiment and showing a round hole penetrating in the axial direction that is provided on the tip portion 320Fa.

Furthermore, the transport guiding member 330 according to the exemplary embodiment is constituted to be rotatable interlockingly with a nip releasing lever 305 provided on one of ends in the axial direction and serving to release a nip pressure (to be rotatable in such a manner that the peeling member 320 is separated apart from the surface of the heating roll 301 when the nip pressure is released) as shown in FIG. 12. Thus, it is possible to enhance a workability in a jam processing such as paper jamming.

In the fixing device 30 having the structure described above, it is possible to suppress the float or vibration of the tip portion 320Fa, thereby ensuring an excellent peeling property of the recording paper and to contribute to a reduction in a cost through a decrease in the number of components or an enhancement in an assembling property with a simplification of the structure without separately providing an elastic member such as a spring for applying an elastic force to the tip by means of the click-shaped peeling finger 320F formed in such a manner that the tip is elastically deformed by itself in conformity with the shape of the surface of the heating roll 301.

In combination with the plate-shaped peeling baffle 320B formed by a general heat-resistant resin, moreover, it is possible to minimize the number of the relatively expensive peeling fingers 320F to be provided, thereby contributing to a reduction in a cost still more, and furthermore, to maintain an excellent peeling property for a recording paper having low quality which causes a problem of the peeling property.

Although the tandem type digital color copying machine according to an example of the image forming apparatus has been described above, the invention may be applied to a monochrome or black-and-white copying machine or printer. In case of a fixing device to be used in the monochrome or black-and-white copying machine or printer, an elastic layer is not formed on the heating roll 301 but a mold releasing layer is formed thereon in a general configuration. In this case, it is not necessary to pay attention to the hardness of the tip portion 320Fa of the peeling finger 320F.

The technical range of the invention is not restricted to the exemplary embodiment but various changes or improvements may be made without departing from the scope of the invention described in the claims. For example, although the structure in which the peeling member 320 is applied to the heating roll 301 has been illustrated in the exemplary embodiment, it is a matter of course that the peeling member 320 having the same structure may be applied to the pressurizing roll 303 or both the heating roll 301 and the pressurizing roll 303. While there has been illustrated the structure in which the peeling member 320 is formed integrally with the transport guiding member 330 in the exemplary embodiment, moreover, it is a matter of course that the peeling member 320 having the same structure may be attached to the apparatus housing separately from the transport guiding member 330.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A fixing device comprising:

a pair of fixing rotors, at least one of which has a heating source and both of which are rotated in pressure contact with each other; and a click-shaped peeling member provided on a downstream side of the fixing rotors with respect to a transporting direction of a recording medium and disposed in contact with a surface of the fixing rotors, wherein a tip portion of the click-shaped peeling member, which is to come in contact with the surface of the fixing rotors, is configured such that it is elastically deformed in conformity to a shape of the surface of the fixing rotors upon contacting the surface of the fixing rotors.

2. The fixing device according to claim 1, further comprising:

a plate-shaped peeling member disposed opposite to the surface of the fixing rotors in an axial direction of the fixing rotors in non-contact condition, wherein the click-shaped peeling member is provided integrally with the plate-shaped peeling member.

3. The fixing device according to claim 2, wherein the click-shaped peeling member is provided on only a central position in the axial direction.

4. The fixing device according to claim 2, wherein a plurality of click-shaped peeling members are provided in the axial direction.

5. The fixing device according to claim 1, wherein a tip portion of the click-shaped peeling member which is to come in contact with the surface of the fixing rotors has a curved surface which has a greater curvature than that of the surface of the fixing rotors.

6. The fixing device according to claim 1, wherein a round hole to penetrate in the axial direction is formed on a tip portion of the click-shaped peeling member which is to be elastically deformed.

7. The fixing device according to claim 1, wherein a thickness in the axial direction of the tip portion of the click-shaped peeling member which is to be elastically deformed is gradually reduced toward the tip of the click-shaped peeling member.

8. The fixing device according to claim 2, further comprising:

a transport guiding member that guides to transport a recording paper subjected to a fixation, wherein the click-shaped peeling member and the plate-shaped peeling member are provided integrally with the transport guiding member.

9. The fixing device according to claim 8, wherein the transport guiding member is positioned in a bearing portion of the fixing rotors.

10. An image forming apparatus comprising:

a fixing device according to claim 1 and image forming unit for forming an image on a recording medium.

* * * * *